US005469047A

United States Patent [19]

Kumamoto et al.

[11] Patent Number: 5,469,047

[45] Date of Patent: Nov. 21, 1995

[54] TRANSISTOR CIRCUIT

[75] Inventors: Toshio Kumamoto; Takahiro Miki; Hiroyuki Kouno, all of Itami, Japan

[73] Assignee: Mitsubishi Denki Kabushiki Kaisha, Tokyo, Japan

[21] Appl. No.: 311,433

[22] Filed: Sep. 26, 1994

Related U.S. Application Data

[63] Continuation of Ser. No. 871,725, Apr. 21, 1992, abandoned.

[30] Foreign Application Priority Data

Oct. 14, 1991 [JP] Japan ..... 3-264653

[51] Int. Cl.[6] ..... G05F 3/16

[52] U.S. Cl. ..... 323/312; 363/73

[58] Field of Search ..... 323/312, 313, 323/314, 315; 363/73; 327/432, 100, 379, 387, 427, 564, 582

[56] References Cited

U.S. PATENT DOCUMENTS

| | | | |
|---|---|---|---|
| 4,052,626 | 10/1977 | Tuma et al. | 307/261 |
| 4,081,758 | 3/1978 | Steckler | 330/261 |
| 4,538,076 | 8/1985 | Shimada | 307/475 |
| 4,645,957 | 2/1987 | Baliga | 307/570 |
| 4,945,266 | 7/1990 | Mori | 307/570 |
| 5,055,716 | 10/1991 | El Gamel | 307/446 |

FOREIGN PATENT DOCUMENTS

| | | | |
|---|---|---|---|
| 3617610 | 11/1987 | Germany | 307/570 |
| 3839156 | 5/1990 | Germany | 307/570 |

OTHER PUBLICATIONS

"Analog MOS Integrated Circuits for signal processing", Roubik Gregorian, Gaborc. Temes; Jhon Wiley & Sons, 1986 pp. 126–132.

"Analysis and Design of Analog Integrated Circuits", second edition Paul R. Gray, Robert G. Meyer pp. 233–246, pp. 709–718.

*Primary Examiner*—Peter S. Wong
*Assistant Examiner*—Adolf Berhane
*Attorney, Agent, or Firm*—Oblon, Spivak, McClelland, Maier & Neustadt

[57] ABSTRACT

In order to obtain a constant current circuit which has an excellent constant current property and requires no plural bias circuits, a base of an NPN bipolar transistor (5) and a gate of an N-channel MOS transistor (6) are connected to a first terminal (1) in common. A collector of the transistor (5) is connected to a second terminal (2) and a source of a transistor (6) is connected to a third terminal respectively, while a voltage source (59) is connected between the first and third terminals. An emitter of the transistor (5) is connected with a drain of the transistor (6). Identical bias voltages are supplied to the base and the gate, while a gate-to-drain voltage of the transistor (6) is equal to a base-to-emitter voltage of the transistor (5). Thus, the transistor (6) operates in a pentode region, to serve as a constant current load for the transistor (5).

6 Claims, 15 Drawing Sheets

TRANSISTOR CIRCUIT

This application is a Continuation of application Ser. No. 07/871,725, filed on Apr. 21, 1992, now abandoned.

BACKGROUND OF THE INVENTION

1. Field of the Invention

The present invention relates to a transistor circuit, and more particularly, it relates to a transistor circuit such as a constant current source circuit, a voltage-to-current conversion circuit, a level shifter or the like.

2. Description of the Background Art

FIG. 15 is a circuit diagram showing a conventional constant current source circuit. In the circuit shown in FIG. 15, a resistor 31 is provided between an emitter of a bipolar transistor 30 and a ground 57, and a bias potential $V_B$ is supplied to a base of the transistor 30 to feed a current I to its collector. FIG. 16 shows a graph illustrating the state of change of a collector current IC which flows with respect to a collector-to-emitter voltage $V_{CE}$ of a bipolar transistor. There is the so-called pentode region PR, in which a substantially constant collector current IC flows without depending on the collector-to-emitter voltage $V_{CE}$. It is necessary to drive the transistor in this pentode region PR, so that the circuit shown in FIG. 15 operates as a constant current source circuit. In other words, it is necessary to sufficiently increase output resistance.

Considering this with reference to FIG. 15, the potential at the emitter of the transistor 30 reaches a value which is lower than the bias potential $V_B$ by a base-to-emitter voltage $V_{BE}$ when the bias potential $V_B$ of 1.2 V, for example, is supplied to the base of the transistor 30. Since the voltage $V_{BE}$ is about 0.7 V in general, the emitter potential is about 0.5 V. Thus, a voltage of 0.5 V is applied to the resistor 31. Assuming that R represents the resistance value of the resistor 31, the following current flows to the collector:

$$I=(V_B-V_{BE})/R \quad (1)$$

and the circuit shown in FIG. 15 operates as a current source circuit which feeds a current of the value determined by equation (1). A collector potential of the transistor 30 must be in excess of the bias potential $V_B$, so that the transistor 30 operates in the pentode region.

This also applies to a MOS transistor circuit shown in FIG. 17. In this circuit, which comprises a MOS transistor 32 whose source is connected to a ground 57, there is also such a pentode region PR as that shown in FIG. 16 regarding the collector current $I_C$ as a drain current $I_D$ and the collector-to-emitter voltage $V_{CE}$ as a drain-to-source voltage $V_{DS}$ in the figure.

Considering this with reference to FIG. 17, a bias potential $V_B$ of 2.0 V, for example, is supplied to the gate of a transistor 32. In this case, a current I flowing to the drain is determined by the following equation of the pentode region PR of the MOS transistor:

$$I=(\beta/2)(V_{GS}-V_{TH})^2 \quad (2)$$

where β represents a constant called a transistor gain factor which is in proportion to the gate width of the transistor and in inverse proportion to the gate length, $V_{GS}$ represents a gate-to-source voltage, and $V_{TH}$ represents a threshold voltage, which is about 0.8 V in general. When the drain-to-source voltage $V_{DS}$ of the MOS transistor 32 satisfies the following relation:

$$V_{DS} \geqq V_{GS}-V_{TH} \quad (3)$$

the MOS transistor 32 operates in the pentode region PR. Namely, the transistor circuit shown in FIG. 17 operates as a constant current source.

In current mirror circuits shown in FIGS. 18 and 19, it is also preferable that transistors forming the same operate in pentode regions.

While the conventional constant current source circuit has been structured in the aforementioned manner, its constant current property has yet been insufficient. A slight increase Δ of the collector current $I_C$ (or the drain current $I_D$) due to the increase of the collector-to-emitter voltage $V_{CE}$ (or the drain-to-source voltage $V_{DS}$) shown in FIG. 16 is caused by an Early effect in the bipolar transistor (or a channel length modulation effect in the MOS transistor).

In order to reduce this, circuits of FIGS. 20 and 21 which are obtained by increasing single transistors in respective ones of the circuits shown in FIGS. 15 and 17 are also employed. In the circuit shown in FIG. 20, a collector current $I_C$ is commonly fed in bipolar transistors 33 and 34, and an emitter of the transistor 34 is connected to a ground 57 through a resistor 31, similarly to the circuit shown in FIG. 15. However, it is necessary to set two bias potentials $V_{B1}$ and $V_{B2}$ in this case and hence a plurality of bias circuits are required.

In the circuit shown in FIG. 21, a drain current $I_D$ is commonly fed in MOS transistors 35 and 36, and a source of the transistor 36 is connected to a ground 57 similarly to the circuit shown in FIG. 17. Also in this case, two bias potentials $V_{B1}$ and $V_{B2}$ must be set similarly to the circuit of FIG. 20.

This also applies to such a case that a plurality of constant current sources are connected in parallel. FIG. 22 is a circuit diagram showing a constant current circuit which is formed by bipolar transistors 33*a*, 33*b*, . . . 33*n* and 34*a*, 34*b*, . . . , 34*n* and resistors 31*a*, 31*b*, . . . 31*n*. This circuit has such a structure that circuits shown in FIG. 20 are connected in parallel. Namely, bases of the transistors 33*a*, 33*b*, . . . , 33*n* and bases of the transistors 34*a*, 34*b*, . . . , 34*n* are connected in common respectively, while the resistors 31*a*, 31*b*, . . . , 31*n*, which are connected to respective emitters of the transistors 34*a*, 34*b*, . . . , 34*n* are connected in common at a ground 57. Also in this circuit, it is necessary to set two potentials, i.e., a bias potential $V_{B1}$ to be supplied to the bases of the transistors 33*a*, 33*b*, . . . , 33*n* and a bias potential $V_{B2}$ to be supplied to the bases of the transistors 34*a*, 34*b*, . . . , 34*n*.

A circuit shown in FIG. 23 has such a structure that circuits shown in FIG. 21 are connected in parallel. Bases of MOS transistors 33*a*, 33*b*, . . . , 33*n* and bases of MOS transistors 36*a*, 36*b*, . . . , 36*n* are connected in common respectively, and it is necessary to set two bias potentials $V_{B1}$ and $V_{B2}$.

An insufficient constant current property of a transistor causes a problem also in another transistor circuit. FIG. 24 is a circuit diagram showing an emitter follower which is formed by a bipolar transistor 49 and a current source 50. An input terminal 52 and an output terminal 51 are connected to a base and an emitter of the transistor 49 respectively, to cause level shift by a base-to-emitter voltage $V_{BE}$ of the bipolar transistor 49. However, since the amount of level shift is varied with an input potential which is received in the input terminal 52 due to an Early effect of the bipolar transistor 49, an output potential obtained from the output terminal 51 is disadvantageously distorted. This also applies to a source follower circuit shown in FIG. 25. Although the amount of level shift is provided by $V_{TH}+\sqrt{(2I/\beta)}$ and can be adjusted by the value I of a current which is fed by a constant current source 56 in this circuit, an output potential outputted from an output terminal 55 which is connected to an emitter in common with the constant current source 56 is disadvantageously distorted with respect to an input potential received in an input terminal 53 which is connected to a base of a MOS transistor 54 since a constant current property is insufficient due to a channel length modulation effect of the MOS transistor 54.

In the emitter follower circuit shown in FIG. 24, further, the amount of level shift is substantially fixed only at $V_{BE}$. While it is possible to insert a diode 58 between an emitter of a transistor 49 and a current source 50 as shown in FIG. 26 in order to further increase the amount of level shift, the amount of level shift substantially reaches $2V_{BE}$ in this case and this circuit cannot be used to obtain an amount of level shift between $V_{BE}$ and $2V_{BE}$. While it is alternatively possible to adjust the amount of level shift by employing a resistor in place of the diode, such a passive element occupies a large area and unpreferably hinders integration and speeding up.

On the other hand, such a problem that two potentials must be set is also caused in a voltage-to-current conversion circuit. FIG. 27 shows an exemplary structure thereof. Bipolar transistors 37 and 38 form a differential pair, while a bipolar transistor 39, a resistor 40 and a ground 57 are identical in structure to the constant current source shown in FIG. 15. When an input potential $V_{in}$ is supplied to a base of the transistor 37, complementary collector currents flow to terminals 41 and 42 in response to difference between the input potential $V_{in}$ and a bias potential $V_{B2}$. Also in this circuit, therefore, it is necessary to set two potentials, i.e., a bias potential $V_{B1}$ for the constant current source and a bias potential $V_{B2}$ forming the reference of voltage-to-current conversion.

This also applies to an ECL type inverter shown in FIG. 28. Bipolar transistors 45 and 46 form a differential pair, while a bipolar transistor 47, a resistor 48 and a ground 57 are identical in structure to the constant current source shown in FIG. 15. Single load resistors 44 are connected to respective collectors of the transistors 45 and 46. When an input potential $V_{in}$ is supplied to a base of the transistor 45, a large current flows to a transistor which comprises a base receiving a higher one of the input potential $V_{in}$ and a bias potential $V_{B2}$, and a logic taken out from a terminal 43 inverts a logic expressed by the input potential $V_{in}$. Also in this circuit, it is necessary to set two bias potentials $V_{B1}$ and $V_{B2}$.

The aforementioned problems are summarized as follows:

(1) A constant current source circuit including one transistor may have an insufficient constant current property, and when the constant current source circuit is formed by employing two transistors which are fed with a common output current in order to solve this, two bias voltages must be set and hence a plurality of bias circuits are required.

(2) A plurality of bias circuits are also required in a constant current source circuit, such as a current mirror circuit, for example, in which a plurality of constant current source circuits of the item (1) are connected in parallel with each other.

(3) Also in a conventional voltage-to-current conversion circuit, it is necessary to set two voltages of a bias voltage forming the reference of an input voltage and a bias voltage which is necessary for a portion serving as a constant current source. This also applies to an inverter.

(4) In a conventional level shift circuit, an output potential is disadvantageously distorted since a drain current has an insufficient constant current property. Further, the amount of level shift can only be set at a level of about integral times of $V_{BE}$.

SUMMARY OF THE INVENTION

The present invention has been proposed in order to solve the aforementioned problems, and objects thereof are:

(1) to provide a constant current source circuit having a highly accurate constant current property by setting only one bias voltage;

(2) to provide a voltage-to-current conversion circuit or an inverter which operates with setting of only one bias voltage; and (3) to provide a level shifter having small distortion of an output potential which can set an amount of level shift at a level other than a value of about integral times of $V_{BE}$.

A transistor circuit according to the present invention comprises a first terminal, a second terminal, a third terminal, a first bipolar transistor having a first conductivity type collector electrode which is connected to the second terminal, a first conductivity type emitter electrode, and a second conductivity type base electrode which is connected to the first terminal, and a first MOS transistor having a first conductivity type drain electrode which is connected to the emitter electrode of the first bipolar transistor, a first conductivity type source electrode which is connected to the third terminal, and a gate electrode which is connected to the base of the first transistor electrode.

Preferably the transistor circuit further comprises a voltage source which is connected between the first terminal and the third terminal. Alternatively, the transistor circuit further comprises a first power source which is connected to the second terminal, a second power source, and a current source which is connected between the third terminal and the second power source.

Also preferably, the transistor circuit further comprises a fourth terminal which is connected to the emitter electrode.

According to the present invention, the emitter electrode of the first bipolar transistor is connected with the drain electrode of the first MOS transistor, whereby a collector current is made equal to a drain current so that the first MOS transistor operates as a load which feeds a constant current to the emitter of the first bipolar transistor so far as the same operates in a pentode region.

Further, since the base electrode of the first bipolar transistor is connected with the gate electrode of the first MOS transistor, it is possible to set a bias voltage in either transistor by setting a single bias voltage alone. In order to drive the first MOS transistor in the pentode region, it is not necessarily required to increase a drain-to-source voltage beyond a gate-to-source voltage. The drain-to-source voltage may be larger with respect to a voltage which is smaller than the gate-to-source voltage by a threshold voltage of the first MOS transistor. Thus, the first MOS transistor having a threshold value which is larger than a base-to-emitter voltage of the first bipolar transistor operates as a load feeding a constant current to an emitter of the first bipolar transistor.

According to the present invention, as hereinabove described, the first MOS transistor operates as a load for feeding a constant current to the emitter of the first bipolar transistor, whereby it is possible to obtain a constant current circuit having an excellent constant current property. Further, the gate of the first MOS transistor is connected to the base of the first bipolar transistor, whereby only one bias voltage can be set and it is possible to reduce a bias circuit. Further, it is possible to obtain a voltage-to-current conversion circuit or an inverter, which can set only one bias voltage. Further, a level shifter having small distortion of an output potential after level shifting is obtained and it is possible to set the amount of shift at a level other than a value of integral times of a base-to-emitter voltage of a first bipolar transistor. Further, it is also possible to obtain an amount of shift of integral times of a voltage $V_{BE}$, by providing a fourth terminal in the emitter electrode of the first bipolar transistor.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
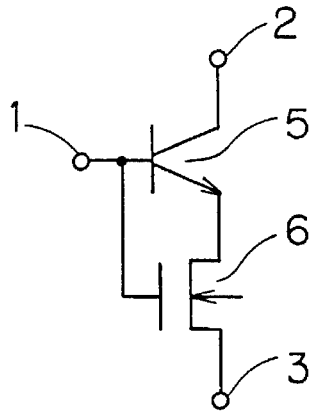
FIG. 1 is a circuit diagram showing a first embodiment of the present invention.

FIG. 1 shows a circuit according to a first embodiment of the present invention. A base of an NPN bipolar transistor 5 and a gate of an N-channel MOS transistor 6 are connected to a first terminal 1 in common. A collector of the bipolar transistor 5 is connected to a second terminal 2 and a source of the MOS transistor 6 is connected to a third terminal 3 respectively. A drain of the MOS transistor 6 is connected to an emitter of the bipolar transistor 5. In the transistor circuit having such a structure, a collector current is substantially equal to a drain current, and the MOS transistor 6 serves as a load for feeding a constant current to the bipolar transistor 5.

In general, a bipolar transistor operates in a pentode region so far as there are potential difference (voltage) of about 0.7 V between a base and an emitter and that at least in excess of the base-to-emitter voltage between a collector and the emitter. Further, a MOS transistor operates in a pentode region if a drain-to-source voltage is larger than a voltage obtained by subtracting a threshold voltage $V_{TH}$ from a gate-to-source voltage, i.e., if the equation (3) holds. Namely, a MOS transistor can sufficiently operate in a pentode region even if a potential of its gate is larger than that of a drain by about $V_{TH}$. If $V_{BE}$ (about 0.7 V) of the bipolar transistor 5 is smaller than $V_{TH}$ of the MOS transistor 6, therefore, both transistors 5 and 6 can sufficiently operate in pentode regions from the following relation:

$$V_{BE}=V_{GS}-V_{DS} \quad (4)$$

Figure 20:
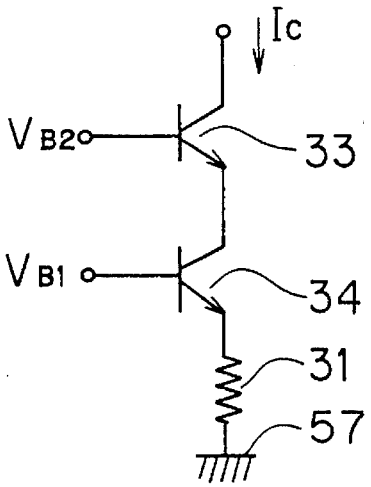
FIG. 20 PRIOR ART
FIG. 20 is a circuit diagram showing a conventional constant current circuit.
Figure 21:
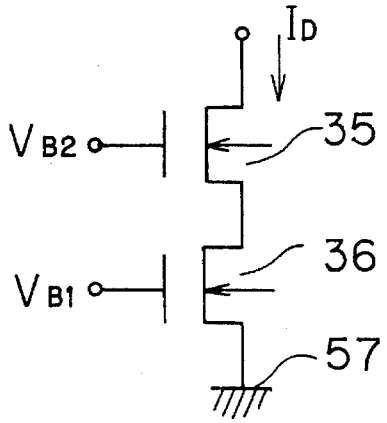
FIG. 21 PRIOR ART
FIG. 21 is a circuit diagram showing a conventional constant current circuit.

In a circuit of FIG. 20 connecting two bipolar transistors, a transistor 34 will not operate in a pentode region when a potential $V_{B1}$ is made equal to a potential $V_{B2}$. Also in a circuit shown in FIG. 21 connecting two MOS transistors, a transistor 35 will not operate in a pentode region when a potential $V_{B1}$ is made equal to a potential $V_{B2}$. In the structure shown in this embodiment, however, it is possible to make both transistors operate in the pentode regions even if the bias voltages $V_{B1}$ and $V_{B2}$ are made common.

Figure 15:
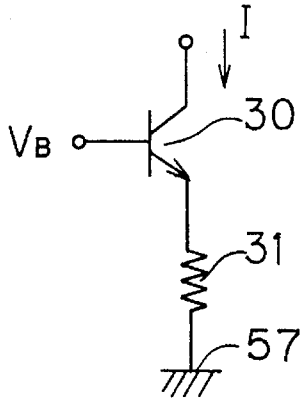
FIG. 15 PRIOR ART
FIG. 15 is a circuit diagram showing a conventional constant current circuit.
Figure 16:
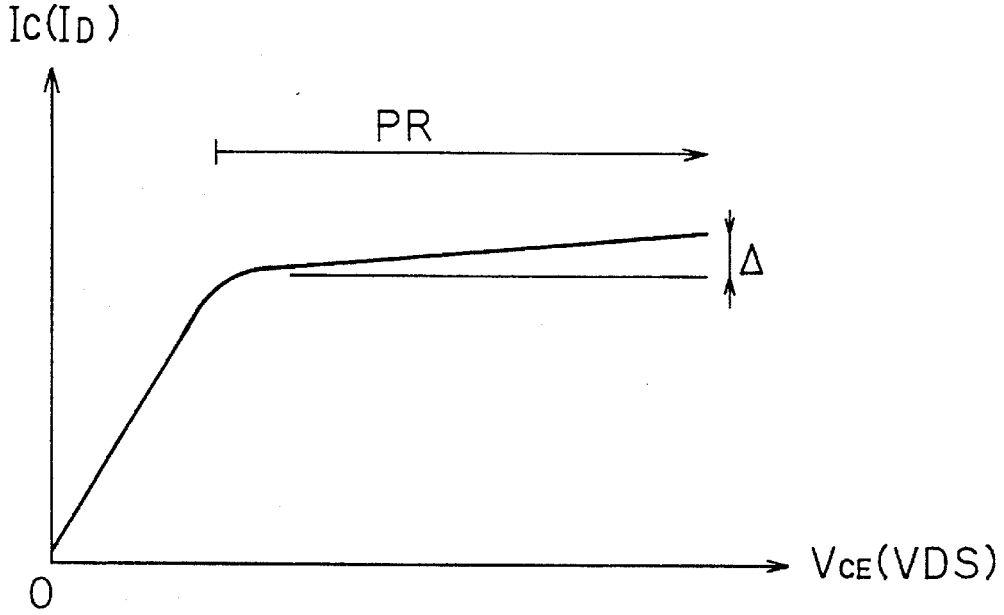
FIG. 16 PRIOR ART
FIG. 16 is a graph showing a pentode region of a transistor.

Although the MOS transistor 6 will not operate in the pentode region if equation (3) is not satisfied, an operation similar to that of the conventional constant current source circuit shown in FIG. 15 is made in this case since the drain current is substantially in proportion to $V_{DS}$. Namely, this embodiment may exhibit a property which is superior to the conventional case but is not deteriorated.

Figure 2:
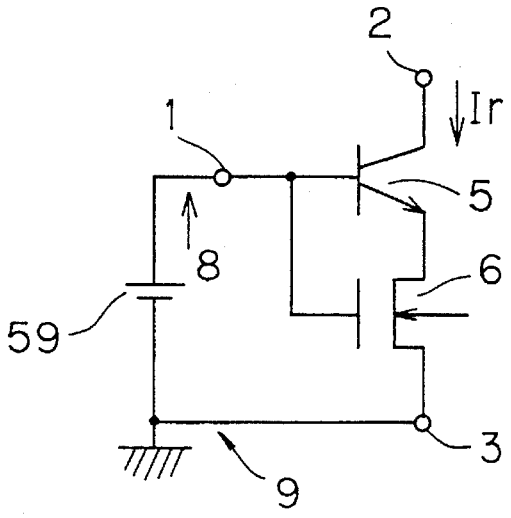
FIG. 2 is a circuit diagram showing a second embodiment of the present invention.
Figure 17:
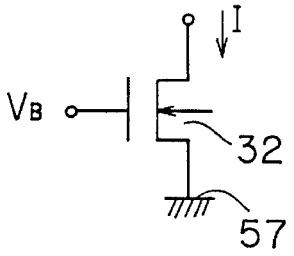
FIG. 17 PRIOR ART
FIG. 17 is a circuit diagram showing a conventional constant current circuit.

FIG. 2 shows a circuit according to a second embodiment of the present invention. With respect to the first embodiment, a first fixed potential 8 and a fixed potential 9 are further supplied to a first terminal 1 and a third terminal 3 respectively. In more concrete terms, a voltage source 59 is connected between the first terminal 1 and the third terminal 3, so that a potential of the first terminal 1 is higher than that of the third terminal 3. Since the voltage source 59 supplies a gate-to-source voltage $V_{GS}$ to a MOS transistor 6, a drain-to-source portion of the MOS transistor 6 serves as a load which feeds a constant current to a bipolar transistor 5, whereby a current Ir drawn in a second terminal 2 is improved in constant current property as compared with currents fed by the constant current source circuits shown in FIGS. 15 and 17 as the result. Further, this embodiment is superior to the constant current source circuits shown in FIGS. 20 and 21 in a point that only a single bias voltage is required.

Figure 3:
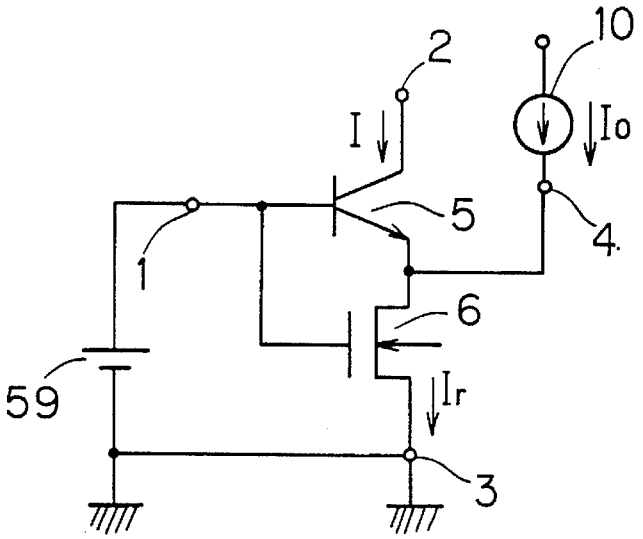
FIG. 3 is a circuit diagram showing a third embodiment of the present invention.

FIG. 3 shows a circuit according to a third embodiment of the present invention. With respect to the second embodiment, a fourth terminal 4 is further connected to the junction between an emitter of a bipolar transistor 5 and a drain of a MOS transistor 6, and a current source 10 for feeding a constant current Io is connected to the fourth terminal 4. In this circuit, a current I drawn in a second terminal 2 is:

$$I=Ir-Io \quad (5)$$

Namely, it is also possible to control an output current value I of a constant current source by adjusting the current value Io flowing in the fourth terminal 4.

Figure 4:
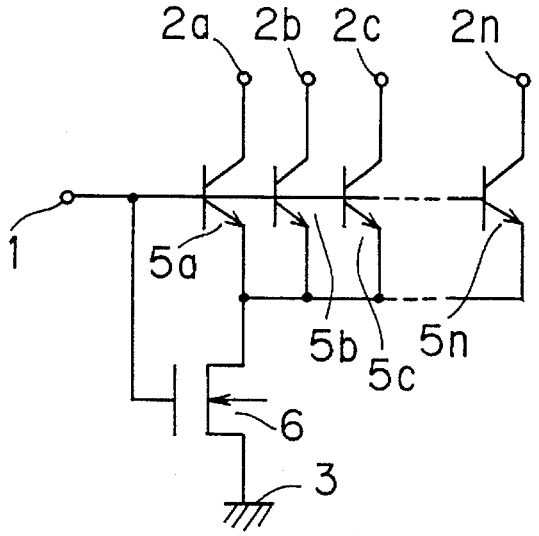
FIG. 4 is a circuit diagram showing a fourth embodiment of the present invention.

FIG. 4 shows a circuit according to a fourth embodiment of the present invention. Respective emitters of a plurality of bipolar transistors 5*a*, 5*b*, 5*c*, . . . , 5*n* are connected in common. Further, respective bases thereof are connected to a first terminal 1 in common. Respective collectors of the bipolar transistors 5*a*, 5*b*, 5*c*, . . . , 5*n* are connected with second terminals 2*a*, 2*b*, . . . , 2*n* respectively. A MOS transistor 6 has a source which is connected to a grounded third terminal 3, a drain which is connected to the emitters of the bipolar transistors 5*a*, and a gate which is connected to the first terminal 1 respectively.

Figure 22:
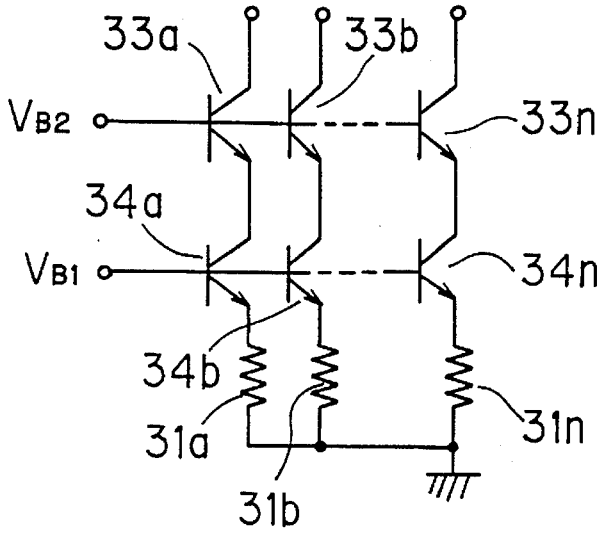
FIG. 22 PRIOR ART
FIG. 22 is a circuit diagram showing a conventional constant current circuit.
Figure 23:
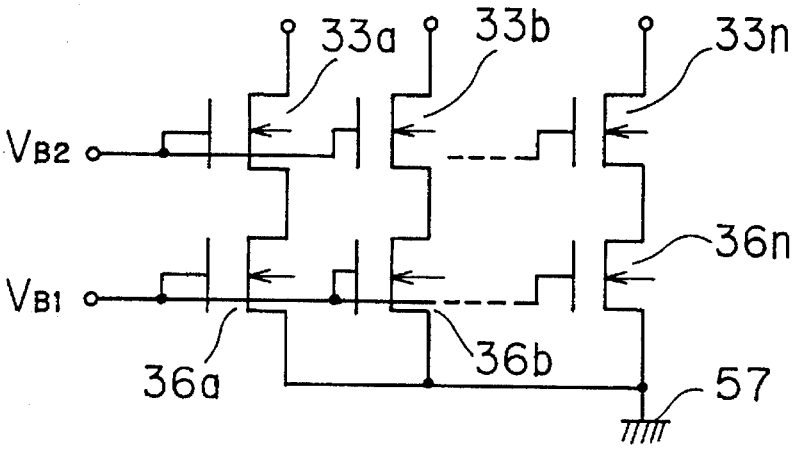
FIG. 23 PRIOR ART
FIG. 23 is a circuit diagram showing a conventional constant current circuit.

In the circuit having such a structure, the MOS transistor 6 serves as a load feeding a constant current with respect to every one of the bipolar transistors 5*a*, 5*b*, 5*c*, . . . , 5*n*. Thus, every one of currents drawn in the second terminals 2*a*, 2*b*, 2*c*, . . . , 2*n* is further improved in constant current property as compared with the constant current circuits shown in FIGS. 22 and 23. When a current value determined at the MOS transistor 6 is uniformly divided in the bipolar transistors 2*a*, 2*b*, 2*c*, . . . , 2*n* to feed a large current of several mA as a whole, it is possible to suppress increase of an occupied area by taking this structure since a MOS transistor has a larger occupied area as compared with a bipolar transistor.

Figure 5:
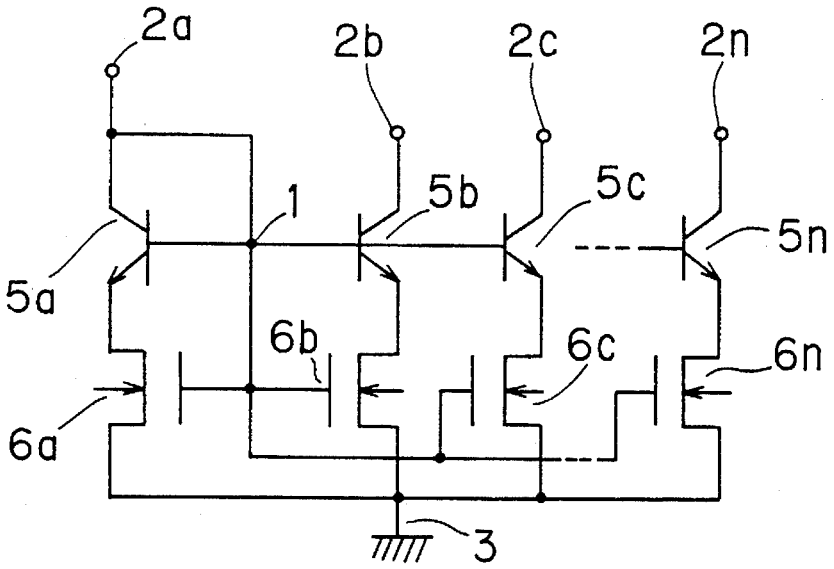
FIG. 5 is a circuit diagram showing a fifth embodiment of the present invention.

FIG. 5 shows a circuit according to a fifth embodiment of the present invention. Second terminals 2*a*, 2*b*, 2*c*, . . . , 2*n*, bipolar transistors 5*a*, 5*b*, 5*c*, . . . , 5*n* and MOS transistors 6*a*, 6*b*, 6*c*, . . . , 6*n* are in connection relations similar to those of the first embodiment. For example, the bipolar transistor 5*a* has a collector which is connected to the second terminal 2*a*, an emitter which is connected to a drain of the MOS transistor 6*a*, and a base which is connected to a gate of the MOS transistor 6*a* respectively. Bases of the bipolar transistors 5*a*, 5*b*, 5*c*, . . . , 5*n* are connected to a first terminal 1 in common, and sources of the MOS transistors 6*a*, 6*b*, 6*c*, . . . , 6*n* are connected to a third terminal 3 in common and grounded. The second terminals 2*a*, 2*b*, 2*c*, . . . , 2*n* are connected to respective collectors of the bipolar transistors 5*a*, 5*b*, 5*c*, . . . , 5*n* respectively. The second terminal 2*a* is connected to the first terminal 1.

Figure 18:
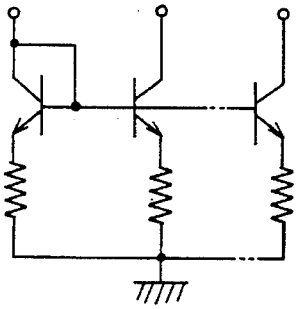
FIG. 18 PRIOR ART
FIG. 18 is a circuit diagram showing a conventional constant current circuit.
Figure 19:
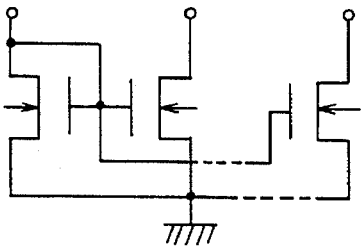
FIG. 19 PRIOR ART
FIG. 19 is a circuit diagram showing a conventional constant current circuit.

In the circuit having such a structure, the MOS transistors 6*a*, 6*b*, 6*c*, . . . , 6*n* serve as constant current loads with respect to the bipolar transistors 5*a*, 5*b*, 5*c*, . . . , 5*n* respectively. Further, since the second terminal 2*a* is set at the same potential as the first terminal 1, currents obtained at the second terminals 2*b*, 2*c*, . . . , 2*n* are controlled by a current which is obtained at the second terminal 2*a*. Namely, the fifth embodiment is in the structure of a current mirror circuit, while a constant current property of the current obtained in each second terminal is improved as compared with those obtained in FIGS. 18 and 19.

As understood from the second to fifth embodiments, the present invention improves a constant current property of a constant current source circuit. Further, although two transistors are connected in series with each other, a required bias potential may be satisfied by a potential having a level for one transistor. When a potential at a second terminal 2 is restricted by an external circuit, therefore, it is possible to take a large dynamic range of an input for a bipolar transistor as compared with the conventional case of making two serially connected transistors in pentode regions.

Figure 6:
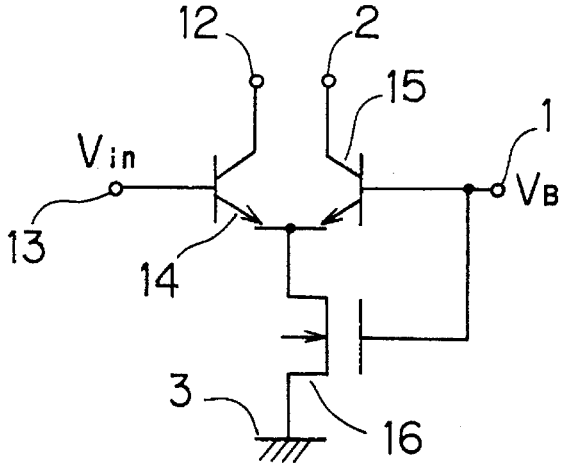
FIG. 6 is a circuit diagram showing a sixth embodiment of the present invention.

FIG. 6 shows a circuit according to a sixth embodiment of the present invention, which is implemented by applying the first embodiment to a voltage-to-current conversion circuit. Emitters of bipolar transistors 14 and 15 are connected to a drain of a MOS transistor 16 in common. A base of the bipolar transistor 15 and a gate of the MOS transistor 16 are connected to a first terminal 1 in common, while a source of the MOS transistor 16 is connected to a third terminal 3 and grounded. On the other hand, an input terminal 13 and an output terminal 12 are connected to a base and a collector of the bipolar transistor 14 respectively. A bias potential $V_B$ is supplied to the first terminal 1 to serve as a reference potential with respect to an input potential $V_{in}$ which is received in the input terminal 13, while the MOS transistor 16 is made to serve as a load for feeding constant currents to the bipolar transistors 14 and 15. Thus, complementary currents flow to the output terminal 12 and the second terminal 2 depending on largeness/smallness of the input potential Vin with respect to the bias potential $V_B$. In a voltage-to-current conversion circuit having such a structure, only one bias potential is required.

Figure 7:
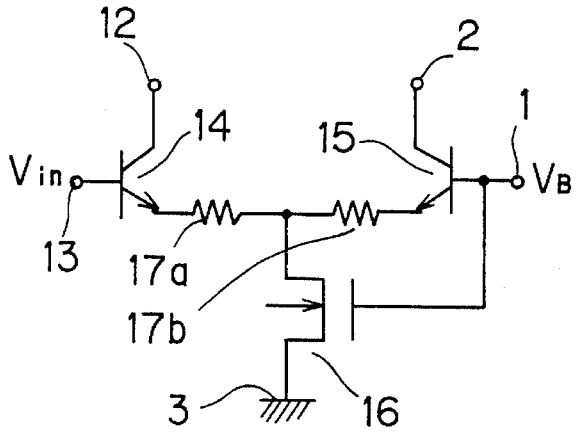
FIG. 7 is a circuit diagram showing a seventh embodiment of the present invention.
Figure 8:
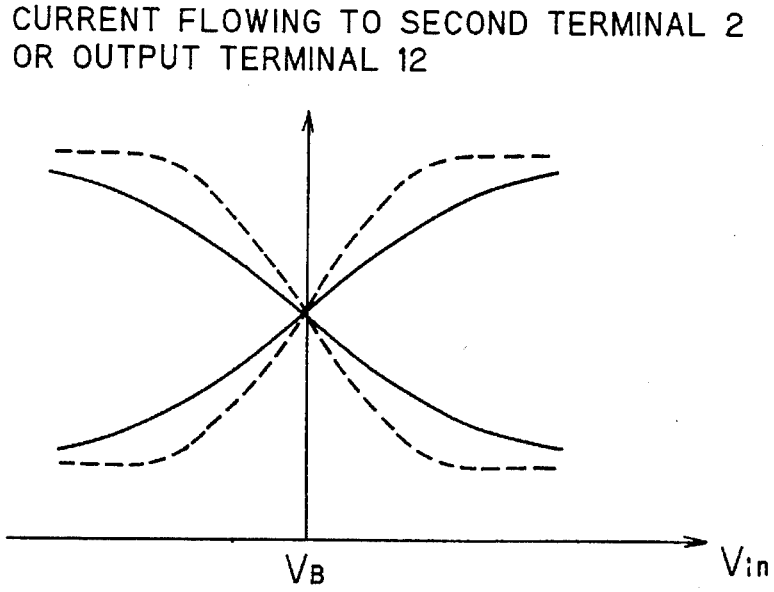
FIG. 8 is a graph showing operations of the sixth and seventh embodiments of the present invention.

FIG. 7 shows a circuit according to a seventh embodiment of the present invention. This embodiment has such a structure that resistors 17*a* and 17*b* are further provided in the sixth embodiment. The resistor 17*a* has an end which is connected to an emitter of a bipolar transistor 14 and another end which is connected to a drain of a MOS transistor 16 respectively. The resistor 17*b* has an end which is connected to an emitter of a bipolar transistor 15 and another end which is connected to the drain of the MOS transistor 16. Thus, it is possible to obtain a voltage-to-current conversion circuit whose linearity of a voltage-to-current conversion characteristic is superior to that of the sixth embodiment, by adding two resistors 17*a* and 17*b*. FIG. 8 shows voltage-to-current conversion characteristics of the sixth and seventh embodiments with broken and solid lines respectively.

Figure 9:
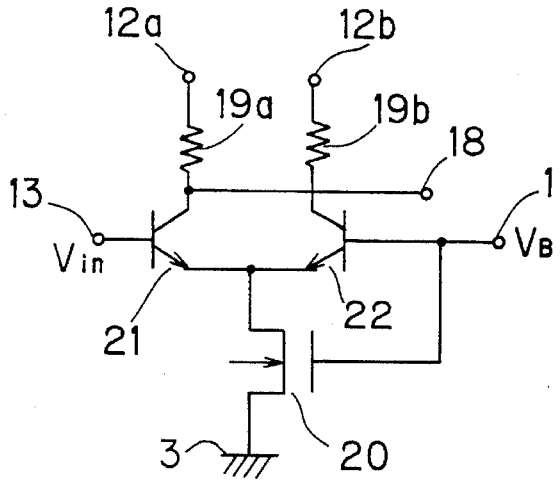
FIG. 9 is a circuit diagram showing an eighth embodiment of the present invention.

FIG. 9 shows a circuit according to an eighth embodiment of the present invention, which is implemented by applying the first embodiment to an ECL type inverter. Emitters of bipolar transistors 21 and 22 are connected to a drain of a MOS transistor 20 in common. A base of the bipolar transistor 22 and a gate of the MOS transistor 20 are connected to a first terminal 1 in common, while a source of the MOS transistor 20 is connected to a third terminal 3 and grounded. On the other hand, an input terminal 13 is connected to a base of the bipolar transistor 21, while an output terminal 18 as well as a terminal 12*a* through a resistor 19*a* are connected to a collector thereof. A bias potential $V_B$ is supplied to the first terminal 1 to serve as a reference potential with respect to an input terminal $V_{in}$ which is received in the input terminal 13, while the MOS transistor 20 is made to serve as a load for feeding constant currents to the bipolar transistors 21 and 22. When a input potential $V_{in}$ which is lower than the reference bias potential $V_B$ is inputted (logic "low"), the current flowing in the MOB transistor 20 flows through the bipolar transistor 22, to increase a potential appearing at the output terminal 18. Namely, the output terminal 18 outputs a logic "high". When the input potential Vin is higher than $V_B$, on the other hand, the potential appearing at the output terminal 18 is reduced and a logic "low" is outputted. In the inverter having such a structure, only one bias potential is required.

Figure 10:
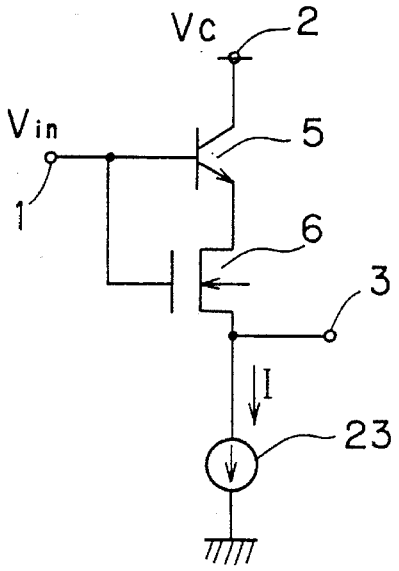
FIG. 10 is a circuit diagram showing a ninth embodiment of the present invention.
Figure 24:
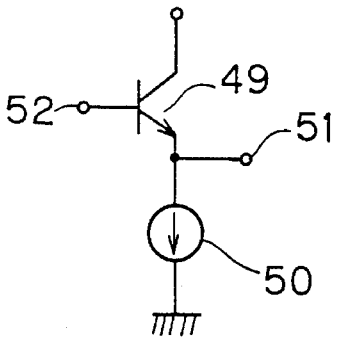
FIG. 24 PRIOR ART
FIG. 24 is a circuit diagram showing a conventional level shifter.
Figure 25:
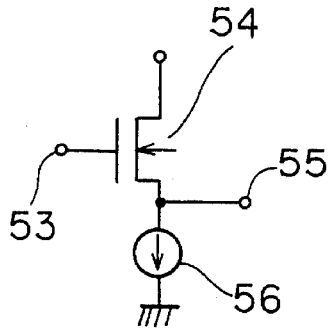
FIG. 25 PRIOR ART
FIG. 25 is a circuit diagram showing a conventional level shifter.
Figure 26:
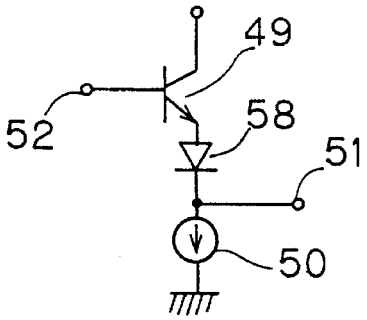
FIG. 26 PRIOR ART
FIG. 26 is a circuit diagram showing a conventional level shifter.
Figure 27:
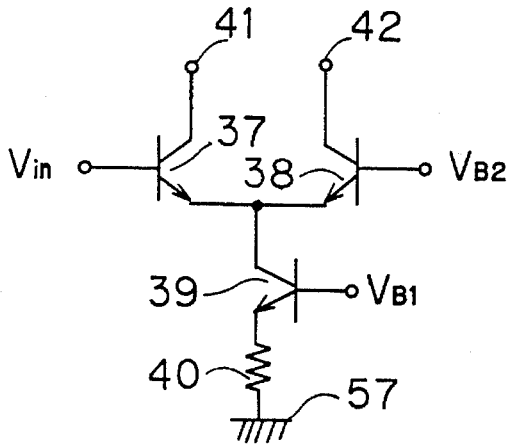
FIG. 27 PRIOR ART
FIG. 27 is a circuit diagram showing a conventional voltage-to-current conversion circuit.
Figure 28:
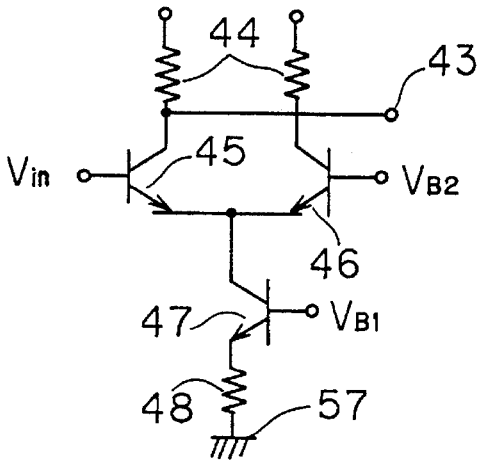
FIG. 28 PRIOR ART
FIG. 28 is a circuit diagram showing a conventional inverter.

FIG. 10 shows a circuit according to a ninth embodiment of the present invention, which is implemented by applying the first embodiment to a level shifter. A third terminal 3 is grounded through a current source 23. A fixed potential $V_C$ is supplied to a second terminal 2. The level of an input potential $V_{in}$ received in a first terminal 1 is shifted to output an output potential at the third terminal 3. The amount of this level shift is identical to that of the source follower circuit shown in FIG. 25, larger than the amount of level shift $V_{BE}$ of the emitter follower circuit of the bipolar transistor shown in FIG. 24 and smaller than the amount of level shift $2V_{BE}$ of the emitter follower circuit of the bipolar transistor including a diode shown in FIG. 26. Namely, it is possible to attain an amount of level shift other than a value of about integral times of a base-to-emitter voltage $V_{BE}$ of a bipolar transistor. However, this embodiment is further improved in constant current property as compared with the source follower circuit shown in FIG. 25. A potential at a drain of a MOS transistor 6 is regularly set at a level which is lower than the input potential $V_{in}$ by a base-to-emitter voltage $V_{BE}$ of a bipolar transistor 5. Regardless of the level of the input potential, therefore, a drain-to-source voltage $V_{DS}$ of the MOS transistor becomes:

$$V_{DS} = V_{in} - V_{BE} - (\sqrt{2I/\beta} + V_{TH}) \quad (6)$$

from the equation (2) to be not fluctuated, whereby it is possible to reduce an influence by a channel length modulation effect and distortion of an output potential appearing at the third terminal 3 is suppressed.

Figure 11:
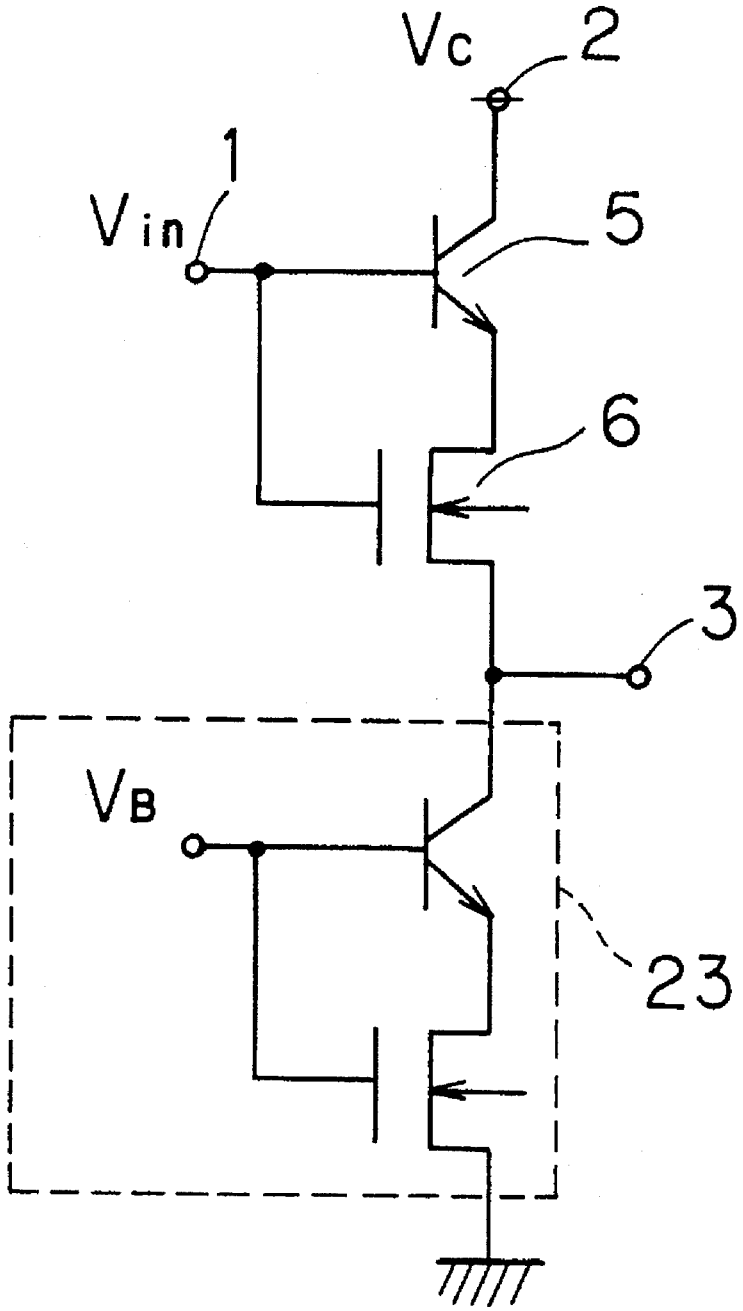
FIG. 11 is a circuit diagram showing a tenth embodiment of the present invention.

FIG. 11 shows a tenth embodiment of the present invention. The current source 23 in the ninth embodiment is formed by the first embodiment. It is possible to obtain an output potential having less distortion as compared with a case of forming a current source by a conventional constant current source circuit such as the circuit shown in FIG. 15, for example.

Figure 12:
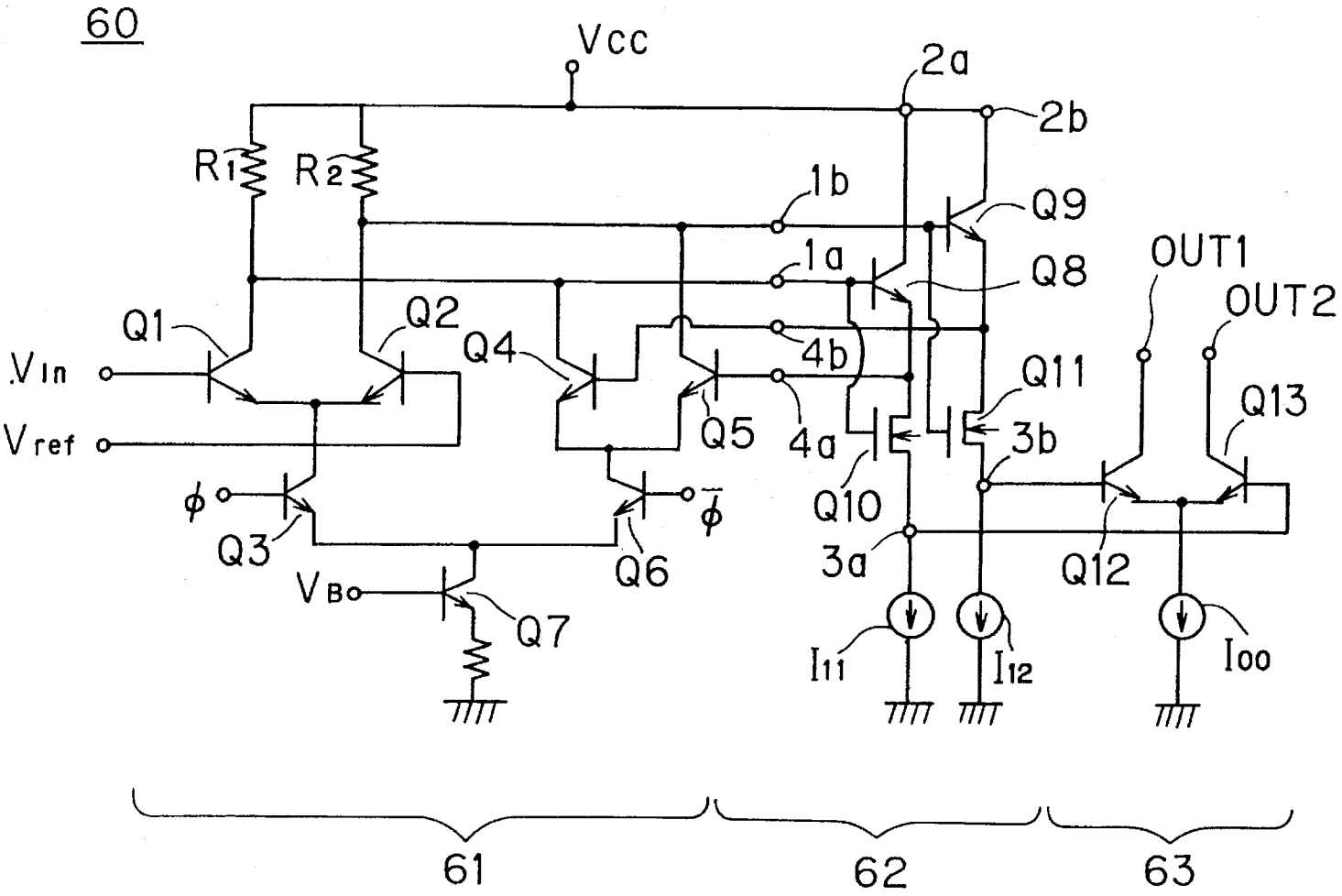
FIG. 12 is a circuit diagram showing an eleventh embodiment of the present invention.
Figure 13:
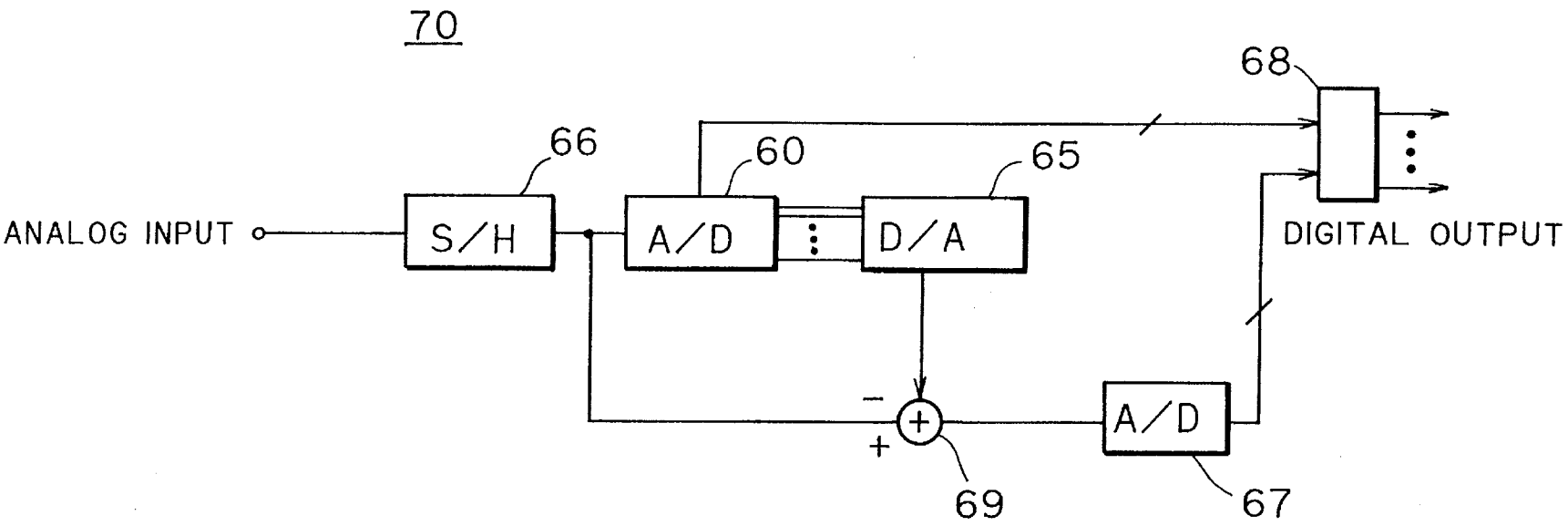
FIG. 13 is a block diagram showing the structure of a D-A convertor 70 to which the eleventh embodiment of the present invention is applied.

FIG. 12 shows an eleventh embodiment of the present invention. This circuit 60 is a series-parallel A-D conversion voltage compare circuit, which supplies a current fed by a current source Ioo to either one of output terminals OUT1 and OUT2 in response to largeness/smallness of an input potential $V_{in}$, which is an analog signal. A D-A converter 65 is connected subsequent to the output terminals OUT1 and OUT2. The circuit 60 is connected to a sample-and-hold circuit 66, an A-D converter 67, an adder 68 and a subtracter 69 to form a part of a series-parallel A-D converter 70 as shown in FIG. 13, for example.

The circuit 60 is formed by a latching comparator 61, a level shifter 62 and a current source part 63. The latching comparator 61 is formed by transistors Q1, Q2 and Q3 for comparing the input potential $V_{in}$ with a reference potential $V_{ref}$, transistors Q4, Q5 and Q6 for performing feedback operations, a transistor Q7 which is supplied with a bias potential $V_B$ to operate as a current source, and resistors R1 and R2.

The level shifter 62 is formed by NPN bipolar transistors Q8 and Q9, N-channel MOS transistors Q10 and Q11 and current sources I11 and I12, in a similar structure to the ninth embodiment of the present invention. Namely, a base of the transistor Q8 and a gate of the transistor Q10 are connected to a first terminal 1*a* in common, while a potential $V_{CC}$ and a collector of the transistor Q8 are connected to a second terminal 2*a* in common. A source of the transistor Q10 is connected to a third terminal 3*a*, and grounded through the current source I11. An emitter of the transistor Q8 and a drain of the transistor Q10 are connected to a fourth terminal 4*a*. Similarly, a base of the transistor Q9 and a gate of the transistor Q11 are connected to a first terminal 1*b* in common, while the potential $V_{CC}$ and a collector of the transistor Q9 are connected to a second terminal 2*b* in common. A source of the transistor Q11 is connected to a third terminal 3*b*, and grounded through the current source I12. An emitter of the transistor Q9 and a drain of the transistor Q11 are connected to a fourth terminal 4*b*.

The current source part 63 is formed by a current source Ioo which is connected to the respective emitters of the current source transistors Q12 and Q13 in common, and output terminals OUT1 and OUT2 which are connected to the respective collectors of the transistors Q12 and Q13.

The latching comparator 61 and the level shifter 62 have the first terminals 1*a* and 1*b* and the fourth terminals 4*a* and 4*b* in common. The level shifter 62 and the current source part 63 have the third terminals 3*a* and 3*b* in common. Namely, the level shifter 62 level-shifts outputs of the compare transistors Q1 and Q2 received by the first terminals 1*a* and 1*b* by a voltage $V_{BE}$ and supplies the same to the bases of the feedback transistors Q5 and Q4 through the fourth terminals 4*a* and 4*b* respectively, while level-shifting the same by a voltage ($V_{BE}$+$V_{DS}$) and supplying the same to the respective bases of the current source transistors Q12 and Q13 through the third terminals 3*a* and 3*b* respectively. Thus, according to the eleventh embodiment, it is possible to provide two different amounts of level shift. Further, it is possible to suppress deterioration of a temperature characteristic which is caused when the level shifter 62 is formed by connecting a number of transistors and employing the same as a diode, and to suppress increase of an occupied area which is caused when the same is formed through a resistor.

Figure 14:
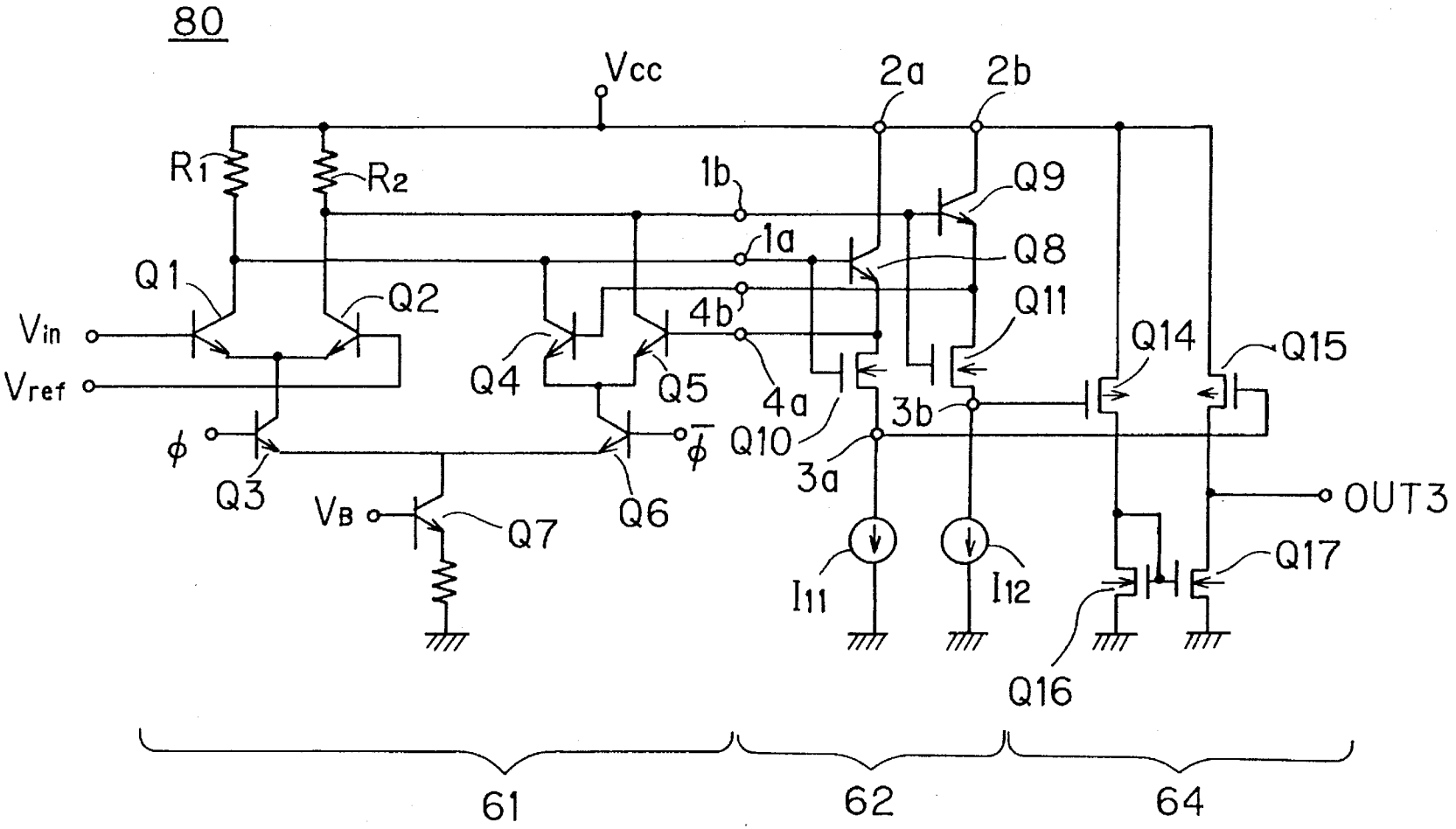
FIG. 14 is a circuit diagram showing a twelfth embodiment of the present invention.

FIG. 14 shows a twelfth embodiment of the present invention. This circuit 80 is a parallel A-D conversion voltage compare circuit, which decides largeness/smallness of an input potential $V_{in}$, being an analog signal at an ECL level and outputs the same at an output terminal as a CMOS level.

The circuit 80 is formed by a latching comparator 61, a level shifter 62, and a current source part 64. In the current source part 64, transistors Q16 and Q17 are serially connected to respective ones of current source transistors Q14 and Q15, while respective gates of the transistors Q16 and Q17 are connected to a drain of the transistor Q16 in common. An output terminal OUT3 is connected to a drain of the transistor Q17, while third terminals 3*b* and 3*a* are connected to respective bases of the transistors Q14 and Q15. Also in this circuit 80, therefore, the level shifter 62 level-shifts outputs of compare transistors Q1 and Q2 which are received by the first terminals 1*a* and 1*b* by a voltage $V_{BE}$ and supplies the same to bases of feedback transistors Q5 and Q4 through fourth terminals 4*a* and 4*b* respectively, while level-shifting the same by a voltage ($V_{BE}$+$V_{DS}$) and supplying the same to respective bases of the current source transistors Q14 and Q15 through third terminals 3*a* and 3*b* respectively. Thus, the twelfth embodiment can also provide two different amounts of level shift.

While the first to twelfth embodiments have been described with reference to the cases of employing NPN-type ones as bipolar transistors and N-channel ones as MOS transistors, the present invention is not restricted to such combination of bipolar and MOS transistors as a matter of course, but the present invention can be carried out through combination of a PNP bipolar transistor and a P-channel MOS transistor.

While the invention has been shown and described in detail, the foregoing description is in all aspects illustrative and not restrictive. It is therefore understood that numerous modifications and variations can be devised without departing from the scope of the invention.

What is claimed is:

1. A constant-current transistor circuit comprising:

a first terminal;

a second terminal;

a third terminal;

a first bipolar transistor having a first conductivity type collector electrode being connected to said second terminal, a second conductivity type base electrode being connected to said first terminal, and a first conductivity type emitter electrode; and a first MOS transistor having a first conductivity type drain electrode being connected to said emitter electrode of said first bipolar transistor, a first conductivity type source electrode being connected to said third terminal, and a gate electrode being directly connected to said base electrode of said first bipolar transistor and at the same potential as said base electrode, wherein a base to emitter voltage $V_{BE}$ of the bipolar transistor is less than the threshold voltage $V_{TH}$ of the MOS transistors so that both the bipolar transistor and said MOS transistor operate in a pentode region and said first MOS transistor and said first bipolar transistor function as a current source with said first terminal serving as a single bias terminal for said current source.

2. A transistor circuit in accordance with claim 1, further comprising a voltage source being connected between said first terminal and said third terminal.

3. A constant current transistor circuit comprising:

a first terminal;

a second terminal;

a third terminal;

a fourth terminal;

a first bipolar transistor having a first conductivity type collector electrode being connected to said second terminal, a first conductivity type emitter electrode being connected to said fourth terminal, and a second conductivity type base electrode being connected to said first terminal;

a first MOS transistor having a first conductivity type drain electrode being connected to said emitter electrode of said first bipolar transistor, a first conductivity type source electrode being connected to said third terminal, and a gate electrode being directly connected to said base electrode of said first bipolar transistor and at the same potential as said base electrode, wherein a base to emitter voltage $V_{BE}$ of the bipolar transistor is less than the threshold voltage $V_{TH}$ of the MOS transistors so that both the bipolar transistor and said MOS transistor operate in a pentode region and said first MOS transistor and said first bipolar transistor function as a current source with said first terminal serving as a single bias terminal for said current source; and a further current source being connected to said emitter electrode of said first bipolar transistor at said fourth terminal.

4. A transistor circuit comprising:

a first terminal;

a second terminal;

a third terminal;

a fourth terminal;

a first bipolar transistor having a first conductivity type collector electrode being connected to said second terminal, a first conductivity type emitter electrode being connected to said fourth terminal, and a second conductivity type base electrode being connected to said first terminal;

a first MOS transistor having a first conductivity type drain electrode being connected to said emitter electrode of said first bipolar transistor, a first conductivity type source electrode being connected to said third terminal, and a gate electrode being connected to said base electrode of said first bipolar transistor;

a latch comparator having a feedback transistor; and a constant current circuit having a current control transistor, said feedback transistor having a control electrode being connected to said fourth terminal, said current control transistor having a control electrode being connected to said third terminal.

5. A voltage-to-current conversion transistor circuit comprising:

an input terminal;

first and second output terminals;

first and second power source terminals;

a first bipolar transistor having a first conductivity type collector electrode being connected to said first output terminal, a second conductivity type base electrode being connected to said input terminal, and a first conductivity type emitter electrode;

a second bipolar transistor having a first conductivity type collector electrode being connected to said second output terminal, a second conductivity type base electrode being connected to said first power source terminal, and a first conductivity type emitter electrode; and a MOS transistor having a first conductivity type drain electrode being connected to said emitter electrodes of said first and second bipolar transistors, a first conductivity type source electrode being connected to said second power source terminal, and a gate electrode being directly connected to said base electrode of said second bipolar transistor and at the same potential as the base of said second bipolar transistor, wherein a base to emitter voltage $V_{BE}$ of the second bipolar transistor is less than a threshold voltage $V_{TH}$ of the MOS transistor so that said second bipolar transistor and said MOS transistor operate in a pentode region and function as a current source with said second input terminal serving as a single bias terminal for said current source, and where complementary currents flow to said first and second output terminals in dependence on the relative amplitude of an input voltage applied to said input terminal in relation to the amplitude of a voltage applied to said second power source terminal.

6. A transistor circuit in accordance with claim 5, further comprising:

a first resistor being connected between said emitter electrode of said first bipolar transistor and said drain electrode; and a second resistor being connected between said emitter electrode of said second bipolar transistor and said drain electrode.

* * * * *